United States Patent [19]

Hilton

[11] 4,264,180

[45] Apr. 28, 1981

[54] PROCESSING APPARATUS

[76] Inventor: Richie C. Hilton, Flat 3, 50 Noble St., Allawah, New South Wales, 2218, Australia

[21] Appl. No.: 85,257

[22] Filed: Oct. 16, 1979

[30] Foreign Application Priority Data

Oct. 18, 1978 [AU] Australia ..... PD6451

[51] Int. Cl.[3] ..... G03D 5/04

[52] U.S. Cl. ..... 354/318; 354/319; 354/325; 134/64 P

[58] Field of Search ..... 354/317, 318, 319, 324, 354/325; 134/64 P, 122 P

[56] References Cited

U.S. PATENT DOCUMENTS

| | | | |
|---|---|---|---|
| 3,616,742 | 11/1971 | Boyle et al. | 354/319 |
| 3,714,883 | 2/1973 | Hunicke et al. | 354/318 |
| 3,999,511 | 12/1976 | Schwandt et al. | 354/318 |
| 4,142,194 | 2/1979 | Hamlin | 354/325 |
| 4,190,345 | 2/1980 | Taylor | 354/318 |

FOREIGN PATENT DOCUMENTS

| | | |
|---|---|---|
| 489676 | 8/1978 | Australia . |
| 547673 | 9/1942 | United Kingdom . |
| 1040342 | 8/1966 | United Kingdom . |
| 1119733 | 7/1968 | United Kingdom . |
| 1135412 | 12/1968 | United Kingdom . |
| 1159126 | 8/1969 | United Kingdom . |
| 1224023 | 3/1971 | United Kingdom . |
| 1276382 | 6/1972 | United Kingdom . |
| 1292200 | 10/1972 | United Kingdom . |
| 1337485 | 11/1973 | United Kingdom . |

*Primary Examiner*—L. T. Hix
*Assistant Examiner*—Alan Mathews
*Attorney, Agent, or Firm*—Stevens, Davis, Miller & Mosher

[57] ABSTRACT

An apparatus for processing photosensitive strip material including a developing station, a fixing station, a washing station, and a stabilizing station. The developing station includes a plurality of developing applicator rollers disposed in three parallel horizontal banks, a drip feed conduit above the applicator rollers, endless conveyors between the banks, and idler rollers below the applicator rollers and conveyors. The fixing station is similar to the developing station but has only two parallel horizontal banks of applicator rollers. The washing station includes a plurality of rollers disposed in a chamber flushed with continuously running water. The stabilizing station includes a plurality of stabilizing applicator rollers disposed in two parallel horizontal banks with endless conveyors between the banks and drip feed conduits above the applicator rollers.

6 Claims, 1 Drawing Figure

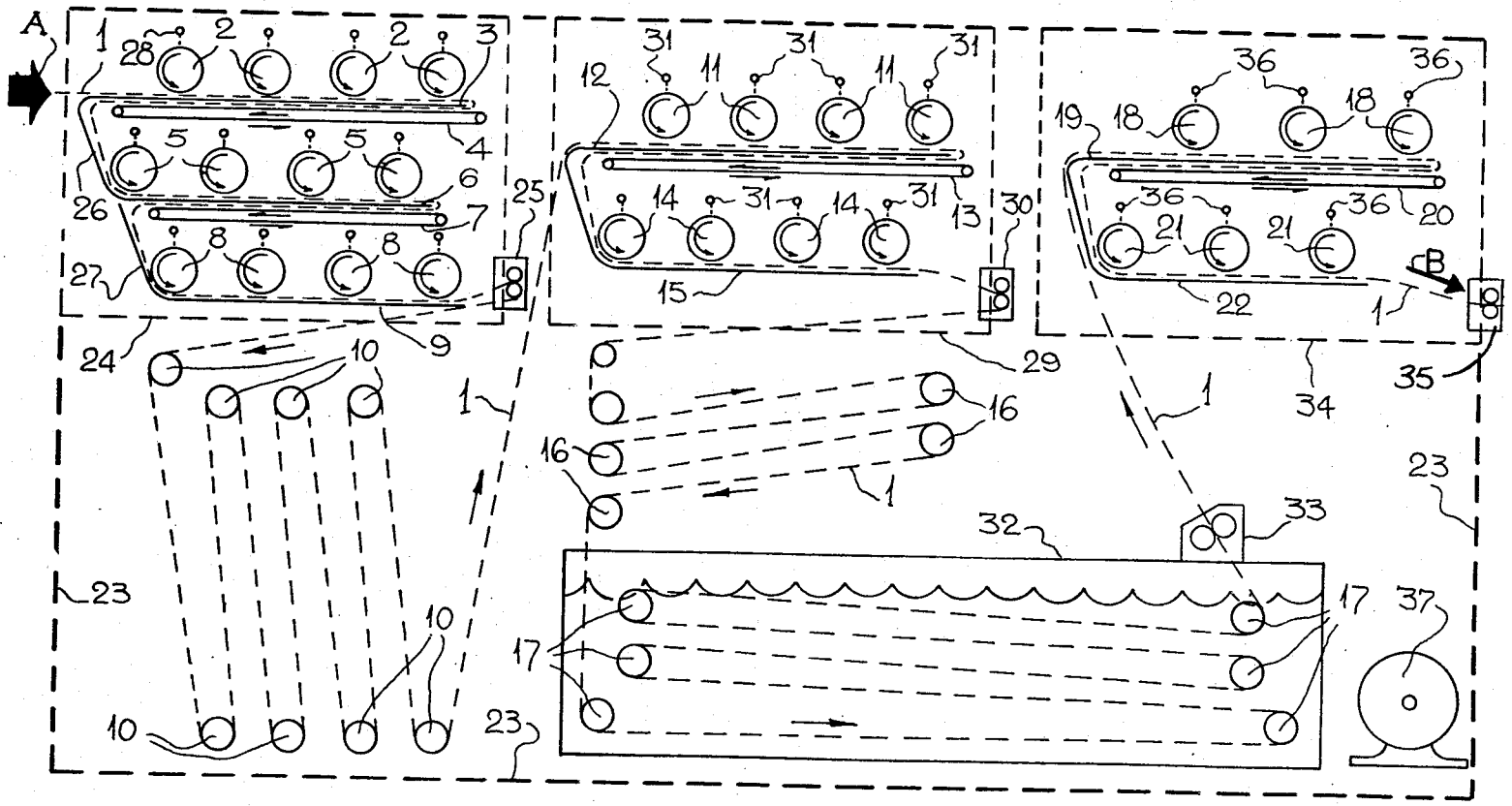
A
B
1
2
3
4
5
6
7
8
9
10
11
12
13
14
15
16
17
18
19
20
21
22
23
24
25
26
27
28
29
30
31
32
33
34
35
36
37

PROCESSING APPARATUS

This invention relates to a processing apparatus and more particularly to such apparatus capable of the continuous developing, fixing, washing and stabilizing of photosensitive strip material described and claimed in the specification relating to Commonwealth Patent No. 489,676.

As far as the applicant is aware, at the present time all prior art commercial colour processing is done by what is known as a sheet-fed 'tank' or 'drum' processing apparatus. This is essentially a batch-processing arrangement and occupies about 7 or 8 minutes to complete a cycle of developing, fixing washing and stabilizing a "charge" of photosensitive material.

The present invention has been received with considerable enthusiasm, particularly in the United States of America where those skilled in this art look upon it as something of a "breakthrough" invention much in advance of all known prior art.

It is therefore an object of the present invention to provide apparatus by means of which the developing, fixing, washing and stabilizing of such photosensitive material can be accomplished continuously in a manner which is simple, rapid and remarkably efficient.

Thus, according to the present invention, a processing apparatus comprises a developing station; a fixing station downstream of said developing station; a washing station downstream of said fixing station; and a stabilizing station downstream of said washing station:

said developing station including a plurality of developing applicator rollers disposed in three parallel, horizontal banks, an endless conveyor between each said bank and the adjacent one, a plurality of idler rollers disposed below said developing applicator rollers and said endless conveyors, and means disposed above said developing applicator rollers to deliver dripwise thereon developing fluid:

said fixing station including a plurality of fixing applicator rollers disposed in two parallel, horizontal banks, an endless conveyor between said banks, a plurality of idler rollers disposed between said fixing applicator rollers and said conveyor, and means disposed above said fixing applicator rollers to deliver dripwise thereon fixing fluid:

said washing station including a plurality of rollers disposed within a chamber flushed with continuously running water: and said stabilizing station including a plurality of stabilizing applicator rollers disposed in two parallel, horizontal banks, an endless conveyor between said banks, an optional plurality of idler rollers disposed below said stabilizing applicator rollers and said conveyor, and means disposed above said stabilizing applicator rollers to deliver dripwise thereon stabilizing fluid.

In order that the reader may gain a better understanding of the present invention, hereinafter is described a preferred embodiment thereof, by way of example only and with reference to the single accompanying drawing which is in the form of a material flow diagram.

In the drawing an already-exposed, intaken photosensitive strip is referenced 1; such strip material as has been exposed in the apparatus described in the specification relating to Commonwealth Patent No. 489,676 is eminently suitable for further processing in the apparatus of the present invention. Photo-sensitive strip 1 enters the processing apparatus at the point indicated by the arrow A and is caused to follow a tortuous path therethrough, finally emerging in finished form at the point indicated by the arrow B. Strip 1 passes between the topmost bank of developing applicator rollers 2 and a first guide plate 3 in a first direction, between guide plate 3 and the top run of the uppermost endless conveyor 4 in a second direction opposite to the first direction, between the intermediate bank of developing applicator rollers 5 and a second guide plate 6 in the said first direction, between second guide plate 6 and the top run of the lowermost endless conveyor 7 in the second direction, and between the lowermost bank of developing applicator rollers 8 and a third guide plate 9 in the first direction. Thence photo-sensitive strip 1 passes sinuously about the plurality of developing station idler rollers 10 for intake into the fixing station.

Entering the fixing station, the now-developed photo-sensitive strip 1 is caused to follow a path between the upper bank of fixing applicator rollers 11 and a guide plate 12 in the aforesaid first direction, between this guide plate 12 and the top run of the endless conveyor 13 in the second direction, and between the lower bank of fixing applicator rollers 14 and guide plate 15 in the first direction. Thence photo-sensitive strip 1 passes sinuously about the plurality of fixing station idler rollers 16 for subsequent intake into the washing station where it passes sinuously about the washing station rollers 17.

The now-developed, fixed and washed photo-sensitive strip 1 is then caused to enter the stabilizing station in which it follows a path between the upper bank of stabilizing rollers 18 and a guide plate 19 in the first direction, between guide plate 19 and the top run of the endless conveyor 20, and between the lower bank of stabilizing rollers 21 and lower guide plate 22 for ultimate discharge from the processing apparatus at the point indicated by the arrow B.

The four process stations may be aligned upon a suitable frame and or within a suitable housing, schematically represented by the large rectangle 23 drawn in heavy chain-line. Frame or housing 23 may well be a timber or metal girder-like structure to the top of which the developing, fixing and stabilizing stations are affixed and within which may be accommodated the washing station and other associated components to be hereinafter described.

The developing station, schematically represented in the drawing by the rectangle 24 drawn in light chain-line, preferably has twelve applicator rollers 2, 5, 8 in three parallel, horizontal banks of four each, disposed en echelon; between the topmost bank of rollers 2 and the intermediate bank of rollers 5, and between these rollers 5 and the lowermost bank of rollers 8 there are provided, respectively, endless conveyors 4 and 7 each spaced apart from the lowermost points of roller banks, 2 and 5, above them.

Each of the said conveyors 4, 7 has, at each end, a roller of rubber or of some such similar material and connected for conveying motion by a number of endless elements of such as thin plastics band, strips or tubes—advantageously plastics 'spaghetti' may be employed—to provide the 'run' between the pair of rollers.

Beneath the applicator rollers 2, 5, 8 and the conveyors 4 and 7 there are eight idler rollers 10, also disposed en echelon, about which the photo-sensitive strip 1 may travel sinuously and substantially vertically. A pair of nip rollers 25 is provided between applicator and idler rollers to ensure that strip 1 is kept taut as it travels through developing station 24.

To permit smooth passage of the photo-sensitive strip 1 between applicator rollers and conveyors, guide plates 3 and 6 are provided. Guide plate 3 is spaced closely between the bank of applicator rollers 2 and the top run of the upper endless conveyor 4, while guide plate 6 is spaced closely between the bank of applicator rollers 5 and the top run of the intermediate endless conveyor 7. Below the lowermost bank of applicator rollers 8 is a further guide plate 9. These guide plates 3, 6 and 9 are co-extensive with, and at least as wide as, the applicator rollers and endless conveyors and are ideally made of a rigid plastics material such as 'Perspex'. At their leading ends the guide plates 3 and 6 are connected by a portion 26 which constitutes a downturned valance so far as guide plate 3 is concerned in this embodiment.

Guide plate 9 has a generally corresponding portion 27 which is, however, upturned: it will be appreciated that guide plate 3 might equally well have a downturned valance extending to, say, just beneath the extreme left-hand roller 5 while guide plate 6 might have a similar downturned valance extending to just beneath the extreme left-hand roller 8.

Above each developing applicator roller and extending parallel thereto there is an apertured conduit 28, only one of which is referenced in the drawing, in the interests of clarity. These conduits are preferably made from copper or stainless steel, fed from a manifold, from which a developing fluid of conventional formula may be delivered dripwise onto the applicator rollers below them.

The fixing station is located downstream of the developing station 24 and is schematically represented in the drawing by the rectangle 29 drawn in light chain-line. Fixing station 29 preferably has eight applicator rollers 11, 14 in two parallel, horizontal banks of four each, disposed en echelon; between these two banks of rollers 11, 14 there is an endless conveyor 13, just as described above in relation to the developing station 24. Beneath applicator rollers 11, 14 and the endless conveyor 13 are the idler rollers 16, also disposed en echelon, about which the photo-sensitive strip 1 may travel sinuously and substantially horizontally. A pair of nip rollers 30 is again provided to ensure tautness of photo-sensitive strip 1. Guide plates 12 and 15 are provided below rollers 11, 14, as described previously in relation to developing station 24.

Above each fixing applicator roller and extending parallel thereto is an apertured conduit 31, as described above, from which a fixing fluid of conventional formula may be delivered dripwise onto the applicator roller beneath it.

The washing station is located downstream of the fixing station 29 and is advantageously accommodated within the framework or housing 23. The washing station, schematically represented in the drawing by the rectangle 32 drawn in unbroken line, will generally take the form of a water tank through which the developed and fixed photo-sensitive strip 1 travels sinuously and substantially horizontally about idler rollers 17. At the output or discharge end of washing station 32 there may advantageously be located a pair of squeeze rollers 33 to remove excess water from photo-sensitive strip 1 prior to intake into the last and stabilizing station.

The stabilizing station is located downstream of the washing station 32 and is the final processing station of the present apparatus, being schematically represented in the drawing by the rectangle 34 drawn in light chain-line. Stabilizing station 34 preferably has six applicator rollers 18, 21 in two parallel, horizontal banks of three each positioned en echelon; between these two banks of rollers 18, 21 there is an endless conveyor 20 as heretobefore described in relation to the developing and fixing stations 24 and 29. From the lower bank of applicator rollers 21 photo-senstive strip 1 exits to drying and/or cut-off and/or rewind means via nip rollers 35. As before, guide plates 19 and 22 are provided below rollers 18, 21. Above each stabilizing applicator roller and extending parallel thereto is an apertured conduit 36, as described above, from which a stabilizing fluid of conventional formula may be delivered dripwise onto the stabilizing roller below it. Optional idler rollers may be disposed below the applicator rolls and conveyor, in the manner of the developing and fixing stations.

Each of the various applicator rollers 2, 5, 8, 11, 14, 18 and 21 has an absorbent outer surface somewhat akin to that of a paint applicator roller, while each of the various idler and nip rollers 10, 16, 17, 25, 30, 33 and 35 may have an outer surface of rubber or of a suitable plastics material mounted upon, say, tubes of a metal such as aluminium or its alloys, or, alternatively, each said roller may be formed integrally from suitable rubbers or plastics materials.

In each of the processing stations 24, 29 and 34, all the various applicator rollers and conveyor end-rollers are journalled for rotation in bearings located on the outsides of associated side plates ideally fabricated from such material as stainless steel, aluminium or its alloys, or rigid plastics material, the material being specifically chosen to resist corrosive attack from the various chemical solutions employed in the developing, fixing and stabilizing processes. The washing station rollers 17 may well be journalled for rotation in a rustless subframe submerged in tank 32.

The twenty-six applicator rollers of the preferred embodiment described above are rotationally driven by suitable means which may be gear trains, pulleys and belts, sprockets and chains or the like; particularly favoured are plastics sprockets driven through plastics or rubber transversely-ribbed belts because of their corrosion-resistant properties. These gears, pulleys or sprockets are in turn driven via a drive-shaft and appropriate bevel-gearing powered by a prime mover, schematically represented in the drawing at 37, and all rotate at the same rotational speed.

The four endless conveyors 4, 7, 13 and 20 are also driven via said drive-shaft and bevel gears powered by prime mover 37, all four travelling at the same rate, which may be about $\frac{1}{3}$ of that of the applicator rollers. The nip rollers 25, 30 and 35 are also driven by prime mover 37.

All axles, bearings, gears, pulleys, belts, sprockets, chains and the like are made from corrosion-resisting materials although, as all except, of course, the axles of the various rollers are located outside the side plates, they are also protected from corrosive attack by this very arrangement.

Each of the three chemical processing solutions used—i.e. the developing, fixing and stabilizing fluids—is delivered to its associated manifold and thence to the apertured conduits for dripwise application by means of a metered pump while diluting water is delivered thereto by at least one motor-driven pump, one for each manifold. Prime mover 37, the three metered pumps and the or each motor-driven water pump is housed so as to be easily accessible in the frame or housing or conveniently adjacent thereto. The entire processing apparatus, which may be of the order of 8 to 10 feet long from input to output, may well stand in such as a stainless steel tray, although the reader will appreciate that the apparatus is so designed and constructed that excess processing fluids dripping to waste downwardly through it are reduced virtually to zero.

As will have been seen and understood from the foregoing the present invention provides an apparatus for the continuous developing, fixing, washing and stabilizing of photo-sensitive strip material and as such the extent of treatment of each discrete portion of the said strip is critical and therefore must be timed accurately. As the photo-sensitive strip progresses through the four processing stations of the apparatus at a constant rate, this necessary time parameter is achieved by control of the measurement of the linear path caused to be taken by the photo-sensitive strip through the stations and is brought about by selection of an appropriate number of rollers, conveyors and idlers for each of the stations so that the strip is processed in each station during an optimal period of time in which the required chemical reaction—developing, fixing or stabilizing—goes to completion but not beyond. The manner in which the various processing fluids are brought into effective contact with the photo-sensitive strip, by means of constantly metered flows delivered dripwise onto the applicator rollers, will be found to be considerably more efficient and economical than in any prior art apparatus known to the applicant.

The tortuous path of the photo-senstive strip through the inventive processing apparatus takes place in diverse directions as previously described and is accomplished in about 4 to 5 minutes as compared with the 7 to 8 minutes required in prior art processes.

As the reader will realize from perusal of the abovegoing, while the number of rotatable members of the present invention is large and the linear path of photosensitive strip tortuous, the apparatus is nevertheless a simple and relatively inexpensive one. Moreover, should a breakdown occur, or a malfunction develop, in any of the stations of the apparatus, the afflicted station can be readily removed from the apparatus by simply unbolting it from the frame or housing—for repair at a later and more convenient time—and subsequently replacing it with a substitute station in the form of a subassembly.

The claims defining the invention are as follows:

1. An apparatus for processing photosensitive strip material comprising a developing station, a fixing station downstream of said developing station, a washing station downstream of said fixing station; and a stabilizing station downstream of said washing station:

said developing station including an input for said strip material and a plurality of developing applicator rollers disposed in three parallel horizontal banks, a first endless conveyor between each said bank and an adjacent bank, a plurality of first idler rollers disposed below said developing applicator rollers and said first endless conveyors, said developing applicator rollers, first endless conveyors and first idler rollers being arranged to transport a strip material applied to said input through said developing station, and means disposed above said developing applicator rollers to drip feed developing fluid thereon;

said fixing station being arranged to receive a strip material exiting from said developing station and including a plurality of fixing applicator rollers disposed in two parallel, horizontal banks, a second endless conveyor between said banks, a plurality of second idler rollers disposed below said fixing applicator rollers and said second endless conveyor, said fixing applicator rollers, second endless conveyor and second idler rollers being arranged to transport a strip material through said fixing station, and means disposed above said fixing applicator rollers to drip feed fixing fluid thereon;

said washing station being arranged to receive a strip material exiting from said fixing station and including a plurality of rollers disposed within a chamber flushed with continuously running water for transporting a strip material through said washing station;

said stabilizing station being arranged to receive a strip material exiting from said washing station and including a plurality of stabilizing applicator rollers disposed in two parallel, horizontal banks, a third endless conveyor between said banks, said stabilizing applicator rollers and third endless conveyor transporting a strip material through said stabilizing station, and means disposed above said stabilizing applicator rollers to drip feed stabilizing fluid thereon; and, said photosensitive strip material following a tortuous, sinuous path through said developing station and about said developing station idler rollers, through said fixing station and about said fixing station idler rollers, and hence through said washing and stabilizing stations; said tortuous, sinuous path being so arranged to provide a strip material path length in each station which ensures an optimal time period for developing, fixing, washing and stabilizing of said strip material.

2. The processing apparatus as claimed in claim 1, wherein said developing, fixing, washing and stabilizing stations are aligned upon a frame structure from which they are readily replaceable and removable.

3. The processing apparatus as claimed in claim 2, wherein a guide plate is provided between each bank of applicator rollers and an underlying endless conveyor, said guide plates being co-extensive with and at least as wide as said rollers and endless conveyors and having, at their leading ends, downturned valances extending to a region adjacent said bank of applicator rollers below them.

4. The processing apparatus as claimed in claims 1, 2 or 3, wherein each applicator roller has an absorbent outer surface.

5. The processing apparatus as claimed in claims 1, 2 or 3, wherein said means to deliver fluid to each said station is a manifold supplied with processing fluid by means of a metered pump; a further pump being provided to deliver diluting water thereto.

6. The processing apparatus as claimed in claims 1, 2 or 3, wherein said applicator rollers are rotationally driven by a prime mover, all rotating at the same rotational speed and wherein said endless belts are driven by said prime mover, all travelling at the same rate which is substantially one-third that of said applicator rollers.

* * * * *